United States Patent [19]

Goldstein et al.

[11] Patent Number: 4,715,261

[45] Date of Patent: Dec. 29, 1987

[54] CARTRIDGE CONTAINING PLASMA SOURCE FOR ACCELERATING A PROJECTILE

[75] Inventors: Yeshayahu S. A. Goldstein, Gaithersburg; Derek A. Tidman, Silver Spring, both of Md.; Rodney L. Burton, Springfield; Dennis W. Massey, Manassas; Niels K. Winsor, Alexandria, all of Va.

[73] Assignee: GT-Devices, Alexandria, Va.

[21] Appl. No.: 657,888

[22] Filed: Oct. 5, 1984

[51] Int. Cl.[4] ..... F41F 1/00

[52] U.S. Cl. ..... 89/8; 124/3

[58] Field of Search ..... 89/8; 102/430, 202, 102/291; 376/144, 145, 107, 150; 313/231.31, 231.41, 231.51, 362.1; 315/111.21–111.81; 219/121 PS, 121 PP, 121 PM, 121 P; 60/202, 203.1

[56] References Cited

U.S. PATENT DOCUMENTS

| | | | |
|---|---|---|---|
| 2,360,217 | 10/1944 | Francis | 42/76 |
| 2,648,257 | 8/1953 | Stanley | 89/8 |
| 2,790,354 | 4/1957 | Yoler et al. | 89/8 |
| 2,944,140 | 7/1960 | Giannini et al. | 219/121 PP X |
| 3,148,587 | 9/1964 | Melhart | 89/8 |
| 3,223,822 | 12/1965 | Browning et al. | 219/121 PP |
| 3,233,404 | 2/1966 | Huber et al. | 60/202 |
| 3,318,094 | 5/1967 | Koller | 60/202 |
| 3,468,217 | 9/1969 | Cooley | 89/8 |
| 3,515,932 | 6/1970 | King | 60/202 X |
| 3,712,227 | 1/1973 | Turner | 102/49.7 |
| 3,892,882 | 7/1975 | Guest et al. | 219/121 PP X |
| 3,916,761 | 11/1975 | Fletcher et al. | 89/8 |
| 3,929,119 | 12/1975 | Fletcher et al. | 89/8 X |
| 3,939,816 | 2/1976 | Espy | 89/8 X |
| 4,087,670 | 5/1978 | Miller | 219/121 PP X |
| 4,205,215 | 5/1980 | Willems | 219/121 PS X |
| 4,269,659 | 5/1981 | Goldberg | 376/107 |
| 4,429,612 | 2/1984 | Tidman et al. | 89/8 |
| 4,507,589 | 3/1985 | Prono | 313/231.01 X |
| 4,555,972 | 12/1985 | Heyne | 89/8 |
| 4,590,842 | 5/1986 | Goldstein et al. | 89/8 |

FOREIGN PATENT DOCUMENTS

| | | | |
|---|---|---|---|
| 1067946 | 10/1959 | Fed. Rep. of Germany | 376/144 |
| 1278970 | 9/1968 | Fed. Rep. of Germany | 60/202 |
| 1564123 | 2/1970 | Fed. Rep. of Germany | 315/111.21 |
| 2,350 719 | 4/1975 | Fed. Rep. of Germany | 60/202 |

OTHER PUBLICATIONS

R. J. Vondra et al, "Analysis of Solid Teflon Pulsed Plasma Thruster", Dec. 1970.

Stephenson, W. B. et al, "Two-Stage, Light-Gas Model Launchers", Aerodynamics and Fluid Mechanics, *Aerospace Engineering*, Aug. 1962, pp. 64–65, 102–111.

Titov, V. M. et al, "Acceleration of Solid Particles by Cumulative Explosion", *Soviet Physics-Doklady*, vol. 13, No. 6, Dec. 1968, pp. 549 and 550.

*Primary Examiner*—Deborah L. Kyle
*Assistant Examiner*—John E. Griffiths
*Attorney, Agent, or Firm*—Lowe, Price, Leblanc, Becker & Shur

[57] ABSTRACT

A projectile is accelerated through a gun barrel bore by a cartridge containing a high temperature, high pressure plasma jet source. The cartridge has a geometry enabling it to be loaded into a breech bore of the gun. The plasma jet is supplied to the rear of the projectile and is derived by a tube having an interior wall forming a capillary passage. A discharge voltage applied between spaced regions along the capillary passage ionizes a dielectric to form a plasma. First and second ends of the passage are respectively open and blocked to enable and prevent the flow of plasma through them. The blocked end closes the breech bore.

43 Claims, 3 Drawing Figures

CARTRIDGE CONTAINING PLASMA SOURCE FOR ACCELERATING A PROJECTILE

RELATION TO CO-PENDING APPLICATION

The present application is related to commonly assigned, co-pending application, Ser. No. 471,215, filed Mar. 1,1983, now U.S. Pat. No. 4,590,842.

TECHNICAL FIELD

The present invention relates generally to guns and more particularly to a gun for receiving a cartridge that includes a capillary passage and a dielectric ionizable substance which, when ionized, supplies a high temperature, high pressure, plasma jet to the rear of a projectile in a barrel bore of the gun.

BACKGROUND ART

Presently used guns generally depend on high energy, high density exothermic, chemical propellants to provide high pressure gasses in a chamber and barrel to accelerate a projectile in the chamber through the barrel. Such guns are efficient reliable devices for projectile devices below about 1.5 kilometers per second. However, sound speed limitations of two phase mixtures incorporated in burning propellant grains and gasseous combustion products cause a rapid decline in gun efficiencies for higher projectile velocities. In the hypervelocity range, above 1.5 kilometers per second, it is desirable to use other energy sources to heat conveniently packaged low atomic weight propellants inside of a gun. It appears to be quite attractive to use an electrical source located outside of the gun to supply energy to heat the low atomic weight propellants inside of the gun.

It is, accordingly, an object of the present invention to provide a new and improved apparatus for enabling a gun to accelerate projectiles efficiently to the hypervelocity range.

Another object of the invention is to provide a new and improved hypervelocity gun that employs electrical energy generated outside of the gun to heat low atomic weight propellants located inside of the gun.

DISCLOSURE OF INVENTION

In accordance with one aspect of the present invention, a projectile is accelerated from a gun having a barrel with a bore adapted to receive the projectile and a breech block having a bore aligned with the barrel bore. A cartridge in the breech block bore includes means for supplying a high temperature high pressure plasma jet to the rear of the projectile in the barrel bore. The plasma jet source includes a tube having an interior wall forming a capillary passage. A discharge voltage is supplied by a suitable source between spaced regions along the length of the interior wall while a dielectric ionizable substance is between the regions. The dielectric ionizable substance includes at least one element that is ionized to form a plasma in response to the discharge voltage being applied between the spaced regions. The passage has a diametric length that is short relative to the distance between the spaced regions to form the capillary passage. First and second ends of the passage are respectively open and blocked to enable and prevent the flow of plasma through them. The blocked end closes the breech bore. The plasma forms an electric discharge channel between the spaced regions. Ohmic dissipation occurs in the electric discharge channel to produce a high pressure in the passage to cause the plasma in the passage to flow longitudinally in the passage through the first end to form the plasma jet which accelerates the projectile through the barrel bore.

In the preferred embodiment, the interior wall of the tube forming the capillary passage is solid and includes the dielectric ionizable substance. The element is ablated and ionized from the solid to form the plasma.

In the preferred embodiment, the voltage is supplied to the spaced regions by a first electrode forming the first end and a second electrode that plugs the second end. The first electrode extends longitudinally of the tube toward the gun barrel from adjacent the blocked breech end and abuts against an edge of the tube remote from the blocked breech end and adjacent the barrel bore. The second electrode comprises a metal plate positioned and mounted to block the breech bore.

The capillary passage preferably includes an outwardly flared nozzle through which the jet is injected into the barrel so the jet expands, causing cooling of the jet as it enters the barrel. Thereby, the barrel is not subjected to the very high temperature plasma that is within the capillary passage, to preserve the barrel life.

It is a further object of the invention to provide a cartridge adapted to be inserted into a gun breech bore, which cartridge includes a plasma source for supplying high pressure to a projectile in a barrel bore of the gun, to accelerate the projectile to the hypervelocity range.

A further object of the invention is to provide a new and improved plasma source for accelerating projectiles in gun barrels, wherein the plasma source includes materials that dissociate into low atomic weight constituents thereby generating material with a high sound speed, so that the material flows rapidly out of a capillary tube in which it is located.

A further object of the invention is to provide a reusable cartridge containing a plasma source capable of supplying a high pressure, high velocity jet to a projectile in a gun barrel, to accelerate the projectile to hypervelocities.

It is preferable for the capillary geometry to have a relatively high resistance, such as one-tenth of an ohm. In such a situation, there is an efficient energy transfer by ohmic dissipation from a power supply into the plasma, which in turn streams out of the nozzle with a high velocity, directed flow. Simultaneously, plasma is replenished by radiative ablation of the dielectric wall confining the discharge, to maintain the jet. Such ohmic dissipation in the capillary discharge transfers energy from the electric energy source into the plasma with an efficiency approaching one-hundred percent since the capillary plasma discharge functions as a simple resistor in a circuit energized by the electric energy source. As plasma is ejected through the nozzle at the end of the tube remote from the end of the breech and adjacent the barrel bore the energy is partitioned between plasma pressure, dissociation, ionization energy, and streaming kinetic energy. In response to energy being coupled to the interior wall of the capillary passage, principally by radiation derived from the plasma, the dielectric is ablated from the wall. Thereby, additional plasma is added to the plasma originally formed by the discharge in the passage to assist in maintaining the discharge. The dielectric tube forming the capillary passage can be provided with ablatable large surface area fillers to increase the amount of plasma produced and increase the resistance of the electrical channel formed between the spaced regions. Typically, the filler is many small powder spheres together having a total surface area of 100 to 1000 times the surface area of the cylinder where the filler is located. Because the fillers have an inertial mass much greater than that of the plasma (e.g., 100 times) the plasma quickly flows through the filler and is cooled thereby to assist in preventing ablation of the channel and gun barrel. Alternatively, the filler is water confined in a plastic bag.

The above and still further objects, features and advantages of the present invention will become apparent upon consideration of the following detailed description of several specific embodiments thereof, especially when taken in conjunction with the accompanying drawing.

BEST MODE FOR CARRYING OUT THE INVENTION

Figures 1, 2, 2A:
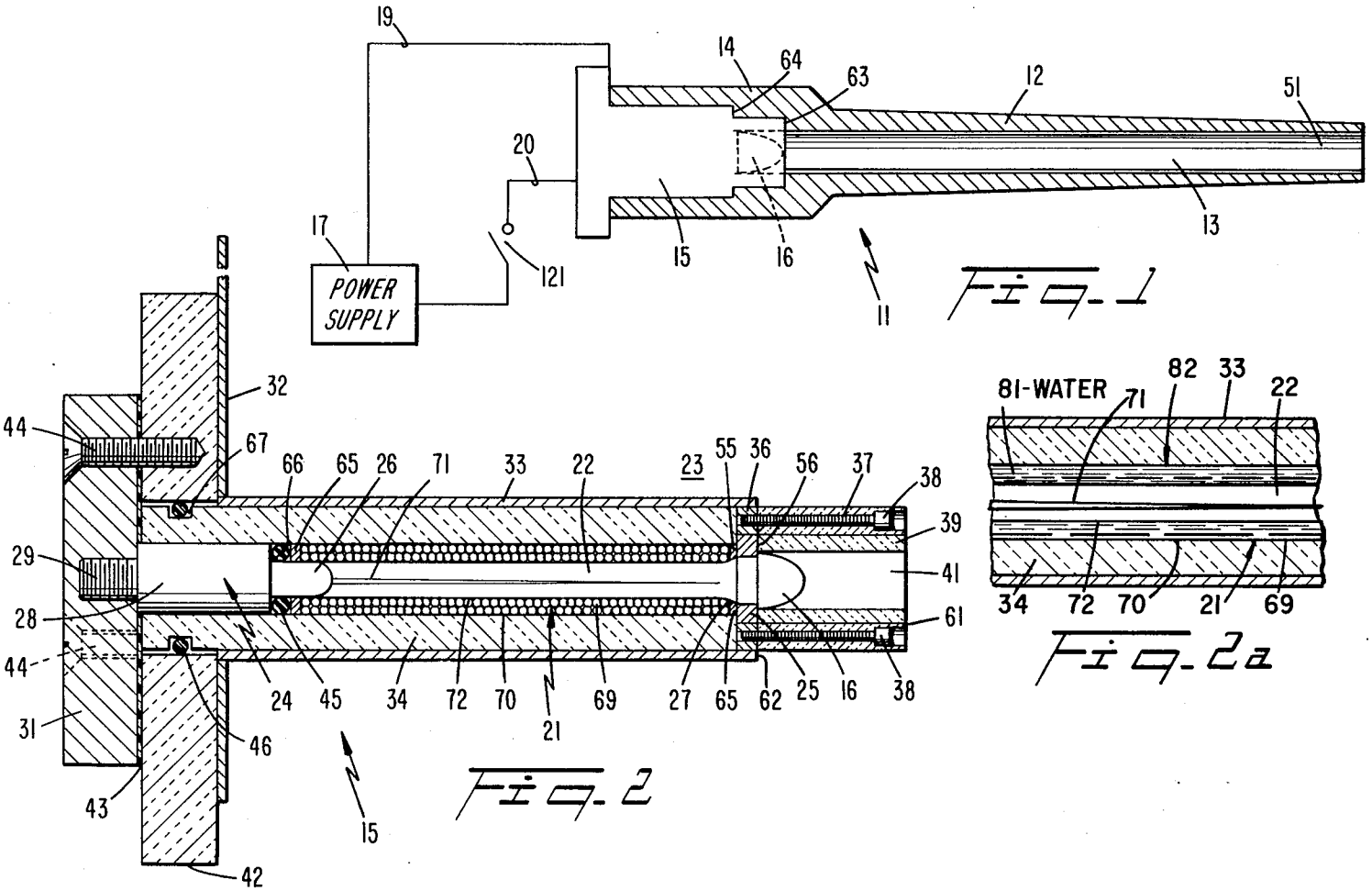
FIG. 1 is a schematic diagram of a cartridge loaded into a breech bore of a gun, in combination with a power supply, in accordance with the present invention.
FIG. 2 is a cross-sectional view of a preferred embodiment of the cartridge illustrated in FIG. 1.
FIG. 2*a* is a partial cross-sectional view of a modification of FIG. 2.

Reference is now made to FIG. 1 of the drawing wherein gun 11 is illustrated as including elongated barrel 12, containing rifled or smooth bore 13. Gun 11 includes a breech 14 in which is located cartridge 15. Cartridge 15 contains projectile or bullet 16. High voltage power supply 17 selectively supplies high voltage, high current electric pulses by way of leads 19 and 20 to a plasma source in cartridge 15 when switch 121 is closed; typically the current and voltage are approximately a few hundred kiloamperes and a few tens of kilovolts.

In response to the electric energy supplied to cartridge 15 by power supply 17, the cartridge supplies a high temperature, high pressure plasma jet to the rear of projectile 16 which is located in barrel bore 13. The plasma jet is derived from a dielectric tube in cartridge 15. The tube has an interior wall that forms a capillary passage. When switch 21 is closed, a discharge voltage is applied between spaced electrodes at opposite ends of the tube so that an ionizable dielectric substance on the tube walls is ionized to form a plasma. The diameter of the tube interior across the passage is relatively short compared to the distance between the electrodes to form the capillary passage. The end of the capillary passage adjacent projectile 16 is flared to form a nozzle through which the jet is injected into barrel 13 at the rear of projectile 16. The jet expands and cools as it flows through the outwardly flared nozzle as it enters bore 13. The blocked end of the capillary tube passage closes the bore in breech 14 in which cartridge 15 is located. The plasma in the capillary passage between the electrodes forms an electric discharge channel in which ohmic dissipation occurs to produce a high pressure. The high pressure in the capillary causes the plasma in the passage to flow longitudinally in the passage and through the open end of the passage to accelerate projectile 16.

The energy of supply 17 necessary to form the plasma can be obtained from several different sources, such as an inductor, a capacitor bank, a homopolar generator, a magneto hydrodynamic power source driven by explosives, or a compulsator, i.e., rotating flux compressor. The electric energy from supply 17 heats the dielectric in the plasma source of cartridge 15 to a temperature in the range of 3,000° K. to 500,000° K.; this is to be contrasted with the temperatures of no greater than 3,000° Kelvin achieved with chemical explosives. Typical chemical explosives in cartridges contain nitrogen, oxygen, carbon and hydrogen. In contrast, the plasma source of cartridge 15 uses ions of carbon, hydrogen and electrons thereof. Due to the combination of high temperature and low atomic weight elements, the pressure of the plasma generated in the cartridge of FIG. 1 contains a large fraction of the plasma energy and the plasma energy is very efficiently transferred to kinetic energy that is applied to projectile 16. Projectile 16 is chased by the plasma as the plasma accelerates through barrel 13 because the sound speed of the plasma of these low atomic weight elements is relatively high compared with that for chemical charge guns. The energy supplied by the plasma typically exerts a pressure in the range of 100 bars to approximately a few hundred kilobars on projectile 16.

Reference is now made to FIG. 2 of the drawing wherein a cross-sectional view of cartridge 15 is illustrated as including dielectric tube 21 having an internal bore that forms cylindrical capillary passage 22. Dielectric tube 21 is formed from a dielectric ionizable substance including at least one element that is ionized in response to a discharge voltage from power supply 17. Preferably the ionizable substance is formed as an ablatable filler having many small, individual powder spheres 69. Spheres 69 are packed in tube 21 between inner and outer thin, easily ruptured dielectric, e.g., a copolymer of vinyl chloride and vinyl acetate, cylindrical walls 70 and 72 and end faces 65. The spheres 69 have a combined surface of 100 to 1000 times the surface area of wall 70. Typically the spheres 69 have an inertial mass much greater, e.g., 100 times, than that of the plasma. The plasma quickly flows through the spheres and is cooled by them to help prevent ablation of the walls of bore 13 of barrel 12 by the plasma. Alternatively, as illustrated in FIG. 2*a*, a confined water mass 81, in liquid or solid form, can be loaded in plastic bag 82 to provide the same result as is attained by spheres 69.

The voltage from supply 17 is supplied across electrode assemblies 23 and 24 having carbon segments 25 and 26 at open and closed ends of passage 22, respectively. Segment 26 is formed as a generally cylindrical stud having an outer edge that engages the interior wall of tube 21 and extends longitudinally into passage 22. Electrode segment 25 is formed as a carbon ring that abuts against planar end 55 of tube 21, to assist in holding the tube in situ. Ring 25 is dimensioned so that a portion of face 56 thereof closest to the axis of tube 21 abuts against the portion of the planar rear face of projectile 16 farthest from the axis of tube 21. Projectile 16 is thereby maintained by ring 25 and collar 37 in situ in cartridge 15, at the breech end of barrel bore 13 and the open flared end 27 of tube 21.

Tube 21 is flared at end 27 to form a nozzle for the plasma jet formed in capillary passage 22. The plasma jet flowing through outwardly flared nozzle 27 is injected against the back face of projectile 16 and into barrel bore 13, so that the jet expands and cools as it enters the barrel bore.

Electrode 24, at the closed end of passage 22, includes a cylindrical metal segment 28 from which stub segment 26 extends. Cylindrical segment 28 is coaxial with stub segment 26, and has a longitudinal axis coincident with the longitudinal axis of tube 21 and a radius equal to the radius of wall 72. Cylindrical segment 28 includes a threaded portion 29 which extends axially in the direction opposite from that of stub segment 26. Segment 29 is threaded into a threaded bore on metal plate 31; plate 31 has a circular cross-section with a radius considerably greater than the common radii of tube 21 and cylindrical segment 28. Thus, electrode 24 is formed of stub segment 26, cylindrical segment 28 and metal plate 31 which block passage 22 at the end of dielectric tube 21 proximate the bore of breech 14 and remote from barrel bore 13. Lead 20 is connected to plate 31 by a suitable connector which can fit about the circular periphery and exposed face of plate 31, to provide a low impedance path between power supply 17 and electrode 24 while switch 121 is closed.

A low impedance connection from lead 19 to carbon ring 25 of electrode assembly 23 is established by metal plate 32 that extends radially from cartridge 15 and the common axes of tube 21, and the remaining elements forming electrode 24, i.e., stub segment 26, cylindrical segment 28 and plate 31. Metal plate 32 abuts against and is fixedly connected to the periphery of copper sleeve 33 at the end of the sleeve remote from collar 37. Sleeve 33 is concentric with tube 21 and the elements of electrode 24. Sleeve 33 is electrically insulated from tube 21 by dielectric tube 34 that is coaxial with tube 21 and extends between plate 31 and carbon ring 25.

The exterior wall 70 of tube 21 and the cylindrical wall of electrode segment 28 abut against the interior wall of tube 34, which assists in holding tube 21 and electrode assembly 24 in situ. The exterior wall of tube 34 abuts against the interior wall of tube 33; the exterior wall of tube 33 abuts against the wall of the bore in breech 14 when cartridge 15 is inserted into the breech. This construction enables sleeve 33 and tube 34 to withstand the very high pressure which is generated in bore 22 when the dielectric on the interior wall of tube 21 is ionized in response to the application of a voltage pulse from power supply 17.

To conduct current flowing in plate 32 and sleeve 33 to carbon ring 25, copper ring 36 is positioned and held in place between the inner diameter of sleeve 33 and the outer diameter of ring 25, so that ring 36 abuts against the face of tube 34 that is aligned with planar end wall 65 of tube 21. Ring 36 is held in situ by cylindrical collar 37 having longitudinally extending threaded bores into which screws 38 are threaded. Collar 37 is integrally formed with sleeve 39, having an interior bore 41 that is aligned with bores 22 and 13; bore 41 has the same diameter as bore 13 of gun barrel 12. The diameter of bore 41 and the diameter of flared nozzle 27 where it intersects face 56 are approximately the same. Carbon ring 25, however, has a radius less than that of bore 41, so that the carbon ring provides a seat for projectile 16, whereby the projectile is positioned at the open end of the capillary passage formed by passage 22. When cartridge 15 is loaded into breech 14 of gun 11, the periphery of collar 37 engages the interior cylindrical wall of the breech bore. The exterior co-planar faces of collar 37 and tube 39, along edge 61, engage forward wall 63 of the breech, between the wall of rifle bore 13 and the exterior of gun 11. Forward edge 62 of sleeve 33 engages corresponding face 64 in breech block 14.

To electrically insulate plates 31 and 32 from each other and provide sufficient strength for cartridge 15 to withstand the high pressures generated in passage 22, plates 31 and 32 are spaced from each other by dielectric face plate 42, formed of a material able to withstand high pressure shocks, such as polyethylene. Metal plate 32 is bonded to one face of plate 42. The other face of plate 42 is bonded to polyethylene film 43. Plate 31 and film 43 are fixedly mounted on plate 42 by screws 44 which extend through threaded bores in plates 31 and 42.

O-rings 45 and 46 assist in holding the entire assembly in place. O-ring 45 has inner and outer diameters approximately equal to the outer diameter of stub cylinder 26 and the diameter of the inner wall of tube 34, respectively. O-ring 45 fits between end face 65 of tube 21 remote from barrel 12 and shoulder 66 on cylindrical segment 28 and bears against the inner diameter of sleeve 34. O-ring 46 fits in peripheral, circular groove 67 about the periphery of tube 34, and has an outer portion that bears against the inner diameter of annular plate 42.

To initiate the discharge under the initial atmospheric conditions which exist in cartridge 15 and gun 11, electrode 24 includes an elongated carbon rod 71 that extends longitudinally from the tip of stub cylinder 26 along the axis or inner wall of passage 22 into proximity with ring 25. In response to a pulse being supplied by supply 17 to cartridge 15, current flows between rod 71 and ring 25 via discharge space between the rod and ring. The rod is consumed by the current but the discharge between ring 25 and cylinder 26 continues. Other types of atmospheric discharge initiators can be used; for example a thin carbon coating can line passage 22. Alternatively, for multiple shot cartridges wherein spheres 69 are replaced by a solid dielectric or the spheres are in containers, only one of which is spent with each shot, a re-usable spark plug type structure can be located between ring 25 and cylinder 26 and supplied with a very high voltage breakdown pulse immediately before switch 121 is closed. The breakdown caused by the spark plug type structure is occurring between ring 25 and cylinder 26 at the time when energy from supply 17 is initially applied between ring 25 and cylinder 26.

While the discharge between electrodes 24 and 25 is occurring the energy from supply 17 is applied between electrodes 24 and 25 by closing switch 121. The energy from supply 17 maintains the discharge between electrodes 24 and 25 to cause a plasma to flow longitudinally in passage 22 to form an electric discharge channel between stub cylinder 26 and carbon ring 25. The resistance of the electric discharge channel is on the order of one-tenth of an ohm, which is considerably higher than any other resistance in the circuit between the terminals of power supply 17. Thereby, virtually all of the energy from power supply 17 is dissipated in the discharge channel formed in passage 22. The plasma formed in passage 22 is highly ionized and very hot, with temperatures ranging from 3,000° Kelvin to as high as 500,000° Kelvin. Because of the capillary nature of passage 22, i.e., the fact that the length to diameter ratio of the passage is at least ten to one, a high pressure is produced in the passage to cause the plasma in the capillary to flow longitudinally into nozzle 27.

The breakdown between stub cylinder segment 26 and carbon ring 25 is initiated along inner dielectric wall 70 of dielectric tube 21 and spreads to dielectric spheres 69 in tube 21. Once breakdown along inner wall 70 and of spheres 69 occurs, plasma from the inner wall and spheres rapidly expands radially into passage 22 to fill the capillary passage defined by the passage. In response to the plasma filling passage 22, there is formed an electric discharge channel which is effectively a resistor between electrodes 24 and 25. The resistance of the discharge channel can be expressed as:

$$R = \frac{l}{\pi\alpha^2\sigma},$$

where R = the resistance between electrodes 24 and 25, l = the length of sleeve 21 between electrodes 24 and 25, $\alpha$ = exterior radius of sleeve 21, and $\sigma$ = the conductivity of the plasma in the thus formed duct.

In response to current flowing through the plasma between electrodes 24 and 25 ohmic dissipation in the plasma transfers energy efficiently from high voltage supply 17 into the plasma. Simultaneously, radiation emission and thermal conduction transport energy from the plasma in passage 22 to spheres 69, to ablate additional plasma from the spheres and replace plasma ejected through nozzle 27. During the period while the plasma flows thru passage 22, spheres 69 remain approximately in situ even though they are not physically confined because the plasma sweeps through the passage at such a high speed and with such a high pressure. Thereby, material in tube 21 is consumed as fuel and ejected as plasma in response to the electric energy provided by high voltage supply 17 when switch 121 is closed.

The resulting high plasma pressure in passage 22 causes plasma in the passage to flow longitudinally along the passage and rapidly out of nozzle 27. Because the other end of passage 22 is blocked by electrode 24, plasma can flow only out of nozzle 27.

The length, l, radius, $\alpha$, and atomic species, typically hydrogen and carbon, in the plasma on the interior diameter of tube 21 are chosen such that the discharge resistance R is relatively large, such as 0.10 ohm, so that it considerably exceeds the sum of the resistance of power supply 17, leads 19 and 20, and electrodes 24 and 25.

If cartridge 15 is to be re-usable the materials forming the cartridge must be able to withstand the high pressure in passage 22 accompanying a discharge voltage being applied between electrodes 24 and 25. If cartridge 15 is of the single shot type, the pressure pulse formed in passage 22 and the materials of cartridge 15 can be such that dielectric tube 34 ripples and deforms in response to the pressure pulse established by the discharge in passage 22. The system, however, can operate satisfactorily for certain applications even if cartridge 15 is destroyed because barrel 12 can be fabricated in such a manner that it is not adversely affected by the high pressure generated in passage 22. In particular, if barrel 12 is fabricated of stainless steel with an inner tungsten liner 51, it is capable of withstanding a 20 kilobar pressure which can be established by the plasma jet.

The material and structure of dielectric tube 21 provide the necessary low atomic weight elemental material, high temperature and high pressure necessary to achieve the desired plasma jet against the rear of projectile 16. The high pressure is needed to accelerate projectile 16 to hypervelocities to provide for efficient transfer of energy from the gas in the plasma to projectile 16 with low losses in bore 13 of barrel 12. The low atomic number of the elements in spheres 69 of dielectric tube 21 and the high temperature created by the plasma together cause the plasma sound speed to be very high, so that the plasma can chase projectile 16 as the projectile moves at high speeds in barrel bore 13. The high temperature of the plasma also enables a large fraction, approximately 50%, of the plasma energy to be contained in pressure kinetic energy, rather than internal states of the molecules, such as ionization or excited atomic states. The large fraction of kinetic energy enables the device to be a highly efficient accelerator for converting the electrical energy of power supply 17 to kinetic energy of projectile 16. The specific cartridge structure can be scaled according to the velocity to be achieved for projectiles having differing masses.

While there has been described and illustrated one specific embodiment of the invention, it will be clear that variations in the details of the embodiment specifically illustrated and described may be made without departing from the true spirit and scope of the invention as defined in the appended claims.

We claim:

1. A cartridge for accelerating a projectile through a bore and muzzle of a gun, the bore being in a barrel of the gun, the gun having a breech having a bore aligned with the barrel bore, the cartridge having a geometry enabling it to be loaded into the breech bore through an end of the breech bore and comprising means for supplying a plasma jet behind a projectile in the barrel bore, the plasma jet supplying means including: a first tube having an interior wall surface forming a capillary passage, the first tube comprising a mass of a dielectric substance confined between the interior wall surface and an exterior wall surface of the tube, a second dielectric tube having an inner wall surface abutting against and confining the exterior wall surface, a metal sleeve having an inside wall surface abutting against and confining an exterior wall surface of the second tube and an outside wall surface adapted to abut against and be confined by the breech bore, first and second electrodes located at opposite ends of the first tube for applying a discharge voltage between spaced region along the length of the interior wall surface while the dielectric ionizable substance is between the regions, the dielectric substance including at least one element that is ionized to form a plasma in response to the discharge voltage being applied between the spaced regions, the diametric length across the passage being short relative to the distance between the spasced regions, first and second ends of the passsage being respectively open and blocked to respectively enable and prevent the flow of plasma th rough them, the block ends closed the breech bore, the plasma forming an electric discharge channel between the spaced regions, ohmic dissipation occurring in the electric discharge channel to produce a pressure in the passage to cause the plasma in the passage to flow longitudinally in the passage and through the first end to form the plasma jet having sufficient pressure to accelerate the projectile from the vicinity of the breech through the barrel and muzzle, and means for establishing electric connections from a source of the discharge voltage to the first and second electrodes through the breech bore end, the electric connection to the second electrode being established via the metal sleeve.

2. The structure of claim 1 further including a collar for restraining movement of the projectile into the capillary passage the collar being secured to and extending from the first end, the collar including a bore adapted to be aligned with the bore of the gun barrel into which the cartridge is adapted to be loaded, the collar bore having the same diameter as the gun barrel bore into which the cartridge is adapted to be loaded, the collar including a shoulder against which the projectile initially bears, wherein the capillary passage includes an outwardly flated nozzle at the first end, the jet being injected through the flared nozzle against the projectile while it bears on the shoulder and thence is injected into the barrel so that jet expands and is cooled as it enters the barrel.

3. The structure of claim 1 wherein the means for supplying further includes means for initiating a discharge between the electrodes at atmospheric pressure.

4. The stucture of claim 1 wherein the mass of the dielectric substance includes ablatable powder filler particles having a total surface area many times that of the interior wall surface of the second tube.

5. The structure of claim 1 wherein the mass of the dielectric substance includes a confined mass of water.

6. The structure of claim 1 wherein the second electrode forms the first end and the first electrode plugs the second end.

7. The structure of claim 6 wherein the second electrode includes a radially extending segment abutting against an edge of the first and second tubes remote from the blocked breech end and adjacent the barrel bore.

8. The structure of claim 7 wherein the first electrode comprises a metal plate positioned and mounted to block the breech bore.

9. The structure of claim 1 further including auxiliary discharge means for initiating the discharge between the spaced regions at atmospheric pressure.

10. The structure of claim 9 wherein the auxiliary discharge means includes: a consumable electrode extending longitudinally of the capillary passage, and means for connecting the consumable electrode to a power supply causing the consumable electrode to be ignited to initiate the discharge between the spaced regions.

11. The structure of claim 10 wherein the consumable electrode is electrically and mechanically connected to the first electrode and is spaced from and electrically insulated from the second electrode.

12. Apparatus for accelerating a projectile comprising a gun having a muzzle and a barrel with a bore adapted to receive the projectile and a breech block having a bore aligned with the barrel bore, a cartridge in the breech block bore, the cartridge including: means for supplying a plasma jet behind the projectile in the barrel bore, the plasma jet supplying means including: a first tube having an interior wall surface forming a capillary passage, the first tube comprising a mass of a dielectric substance confined between the interior wall surface and an exterior wall surface of the tube, a power supply outside of confines of the gun, means connected to said power supply for applying a discharge voltage through electric connections extending through the breech block to first and second electrodes between spaced regions along the length of the interior wall surface while a dielectric ionizable substance is between the regions, the dielectric substance including at least one element that is ionized to form a plasma in response to the discharge voltage being applied between the spaced regions, the diametric length across the passage being short relative to the distance between the spaced regions, first and second ends of the passage being respectively open and blocked to respectively enable and prevent the flow of plasma through them, the blocked end closing the breech block bore, the plasma forming an electric dischasrge channel between the spaced regions, ohmic dissipation occurring in the electric discharge channel to produce a pressure in the passage to cause the plasma in the passage to flow longitudinally in the passage and through the first end to form the plasma jet having sufficient pressure to accelerate the projectile from the vicinity of the breech through the barrel and muzzle, a collar for restraining movement of the projectile into the capillary passage, the collar being secured to and extending from the first end, the collar including a bore adapted to be aligned with the bore of the gun barrel into which the cartridge is adapted to be loaded, the collar bore having the same diameter as the gun barrel bore into which the cartridge is adapted to be loaded, the collar including a shoulder against which the projectile initially bears, wherein the capillary passage includes an outwardly flared nozzle at the first end, the jet being injected through the flared nozzle against the projectile while it bears on the shoulder and then is injected into the barrel so that jet expands and is cooled as it enters the barrel.

13. The apparatus of claim 12 wherein the first electrode forms the first end and the second electrode plugs the second end.

14. The apparatus of claim 13 wherein the first electrode extends longitudinally of the tube toward the gun barrel from adjacent the blocked breech end and abuts against an edge of the tube remote from the blocked breech end and adjacent the barrel bore.

15. The apparatus of claim 14 wherein the second electrode comprises a metal plate positioned and mounted to block the breech bore.

16. The apparatus of claim 12 wherein the means for supplying further includes means for initiating a discharge between the spaced regions at atmospheric pressure.

17. The apparatus of claim 12 wherein the dielectric ionizable substance includes ablatable powder filler particles having a total surface area many times that of the exterior wall surface and an internal mass much greater than that of the plasma so the plasma quickly flows through and is cooled by the particles.

18. The apparatus of claim 12 wherein the capillary passage includes an outwardly flared nozzle through which the jet is injected so the jet expands and is cooled as it leaves the nozzle.

19. The apparatus of claim 12 wherein the voltage applying means includes a first electrode forming the first end and a second electrode plugging the second end.

20. Apparatus for accelerating a projectile comprising means for supplying a high temperature high pressure plasma jet to the projectile, the plasma jet supplying means including: a tube having an interior wall surface forming a capillary passage, means for applying a discharge voltage between spaced regions along the length of the interior wall surface while a dielectric ionizable substance is included in the tube wall between the regions, the dielectric ionizable substance including at least one element that is ionized to form a plasma in response to the discharge voltage being applied between the spaced regions and being formed of powder filler particles that are included in the tube wall and ablated in response to the discharge voltage, the particles having a total surface area many times that of the wall surface and an inertial mass much greater than that of the plasma so the plasma quickly flow through and is cooled by the particles, the diametric length across the passage being short relative to the distance between the spaced regions, first and second ends of the passage being reapectively open and blocked to respectively enable and prevent the flow of plasma through them, the plasma forming an electric discharge channel between the spaced regions, ohmic dissipation occurring in the electric discharge channel to produce a high pressure in the passage, the pressure in the passage being sufficient high to cause the plasma in the passage to flow longitudinally in the passage and through the first end to form the plasma jet.

21. Apparatus for deriving a plasma jet comprising a tube having an interior wall surface forming a capillary passage, means for applying a discharge voltage between first and second spaced regions along the length of the interior wall surface while a dielectric ionizable substance is between the regions, the means for applying including first and second spaced electrodes respectively at the first and second spaced regions, the dielectric substance including at least one element that is ionized to form a plasma in response to the discharge voltage being applied between the spaced regions, the diametric length across the passage being short relative to the distance between the spaced regions, first and second ends of the passage being respectively open and blocked to respectively enable and prevent the flow of plasma through them, the plasma forming an electric discharge channel between the spaced regions, ohmic dissipation occurring in the electric discharge channel to produce a high pressure in the passage, the pressure being sufficiently high to cause the plasma in the passage to flow longitudinally in the passage and through the first end to form the plasma jet, the discharge applying means including auxiliary discharge means for initiating the discharge between the spaced regions at atmospheric pressure, the auxiliary discharge means including: an auxiliary electrode in the passage at a longitudinal position between the spaced regions so the discharge is initiated between one of the spaced regions and the longitudinal position and thence to the other spaced region, and means for selectively connecting the auxiliary electrode to a power supply that initiates the discharge.

22. The apparatus of claim 21 wherein the auxiliary electrode is consumable and extends longitudinally of the capillary passasge, the means for connecting the consumable electrode to the power supply causing the consumable electrode to be ignited to initiated the discharge between the spaced regions.

23. The apparatus of claim 22 wherein the first and second electrodes are respectively at the open and blocked ends, the consumable electrode electrically and mechanically connected to the second electrode and spaced from and electrically insulated form the first electrode.

24. Apparatus for accelerating a projectile comprising means forming a confined path having as longitudinal axis along which the projectile traverses, and means for supplying a pulsed high pressure, high velocity plasma jet to the path and to a rear surface of the projectile, the means for supplying comprising a tube having a longitudinal axis and a wall, the tube having an inner diameter to length ratio to form a capillary passage, the tube having an inner wall surface defining a boundary for the capillary passage, the wall including a dielectric ionizable substance formed of ablatable powder filler particles having a total surface area many times the surface area of the inner wall surface between displaced regions along the tube longitudinal axis and an inertial mass much greater than that of the plasma so the plalsma quickly flows through and is cooled by the particles, and means for applying a discharge voltage to the ablatable powder filler particles between the regions to cause the substance in the particles to be ionized to form the plasma inside of the tube, the tube being dimensioned so that the plasma formed therein in response to the discharge voltage has a high velocity and high pressure to form the jet, the tube having a closed first end while the plasma is formed therein and a second end including an orifice into the confined path, the jet propagating along the longitudinal axis of the tube and through the orifice into the confined path generally in the same direction as the projectile is to be accelerated.

25. Apparatus for accelerating a projectile comprising means forming a confined path having a longitudinal axis along which the projectile traverses, and means for supplying a pulsed high pressure, high velocity plasma jet to the path and to a rear surface of the projectile as the projectile traverses the path to accelerate the projectile along the path, the means for supplying the pulsed high pressure, high velocity plasma jet to the path including a tube having an interior wall surface forming a capillary passage, the tube including ionizable ablatable powder dielectric filler particles abutting against the wall surface and having an inertial mass much greater than that of the plasma so the plasma quickly flows through and is cooled by the particles, means for applying a diacharge voltage between spaced regions along the length of the interior wall surface while the ablatable powder dielectric filler particles are between the regions, the particles having a total surface area many times the surface area of the wall surface between the regions, the dielectric particles including at least one atomic element that is ionized to form a plasma in response to the discharge voltage being applied between the spaced regions, the diametric length across the passage being short relative to the distance between the spaced regions, first and second ends of the passasge being respectively open and blocked while the discharge voltage is applied between the spaced regions to respectively enable and prevent the flow of plasma through them, the plasma forming an electric discharge channel between the spaced region while the discharge voltage is applied between the regions, ohmic dissipation occurring in the electric discharge channel in response to the discharge voltage being applied between the regions to produce a high pressure in the passage to cause the plasma in the passage to flow longitudinally in the passasge and through the first end to form the pulsed plasma jet.

26. Apparatus for accelerating a projectile comprising means forming as confined path having a longitudinal axis along which the projectile traverses, and means for supplying a pulsed high pressure, high velocity plasma jet to the path and to a rear surface of the projectile to accelerate the projectile along the path, the supplying means including a capillary passage having a longitudinal axis and a wall formed of ablatable dielectric, ionizable powder filler particles having a total surface area many times that of an exposed inner surface of the wall, said passage having one closed end and an orifice at another end, the orifice leading into the confined path, means for applying a discharge voltage to the particles between spaced longitudinal regions of the passage in the direction of the passage lognitudinal axis so that the particles form a plasma in the passage, the particles having an inertial mass much greater than that of the plasma so the plasma quickly flows through and is cooled by the particles, an electric discharge channel being formed by the plasma in the passage beteen the spaced passage regions while the discharge voltage is applied between the spaced regions, said one end being closed while the discharge is occurring, ohmic dissipation occurring in the eIectric discharge channel while the discharge voltage is applied between the spaced regions to produce a high pressure in the passage to cause plasma to flow longitudinally in the passage and through the orifice to form the jet that enters the confined path.

27. Apparatus for accelerating a projectile comprising means forming a confined path having a longitudinal axis along which the projectile traverses, and means for supplying a pulsed plasma jet to the path and to a rear surface of the projectile, the means for supplying comprising a tube having a longitudinal axis and a wall, the tube having an inner diameter to length ratio to form a capillary passage, the tube having an inner wall surface defining a boundary for the capillary passage, the wall including a dielectric ionizable substance formed of a mass of water confined to have a predetermined shape, and means for applying a discharge voltage to the water between displaced regions along the tube longitudinal axis to cause at least one atomic element in the water to be ionized to form the plasma inside of the tube, the tube being dimensioned so that the plasma formed therein in reponse to the discharge voltage has a velocity and pressure to form the jet, the tube having a closed first end while the plasma is formed therein and a second end including an orifice into the confined path, the jet propagating along the longitudinal axis of the tube and through the orifice into the confined path generally in the same direction as the projectile is to be accelerated.

28. The apparatus of claim 27 further including a confining structure for the water, the confining structure including surfaces formed by opposite end faces and the inner wall surface, the means for applying the discharge voltage including first and second electrodes abutting against the surface at opposite ends of the structure.

29. The appratus of claim 27 wherein the water is confined by an elongated wall comprising a wall of the capillary passage and formed of a thin dielectric.

30. Apparatus for accelerating a projectile comprising means forming a confined path having a longitudinal axis along which the projectile traverses and means for supplying a pulsed plasma jet to the path and to a rear surface of the projectile as the projectile traverses the path to accelerate the projectile along the path, the means for supplying the pulsed plasma jet to the path including a tube having a wall formed of a mass of water confined to have a predetermined shape, the tube having an interior surface forming a capillary passage, means for applying a discharge voltage between spaced regions along the length of the interior surface while the water is ionizable between the regions, the water including at least one atomic element that is ionized to form a plasma in response to the discharge voltage being applied between the spaced regions, the diametric length across the passage being short relative to the distance between the spaced regions, first and second ends of the passage being respectively open and blocked while the discharge voltage is applied between the spaced regions to respectively enable and prevent the flow of plasma through them, the plasma forming an electric discharge channel between the spaced regions while the discharge voltage is applied between the regions, ohmic dissipation occurring in the electric discharge channel in response to the discharge voltage being applied between the regions to produce a pressure in the passage to cause the plasma in the passage to flow longitudinally in the passage and through the first end to form the pulsed plasma jet.

31. The apparatus of claim 30 wherein the water is confined by an elongated wall comprising a wall of the capillary passasge and formed of a thin dielectric.

32. The apparatus of claim 30 further including a confining structure for the water, the confining structure including surfaces formed by opposite end faces and the interior wall surface, the means for applying the discharge voltage including first and second electrodes abutting against the surface at opposite ends of the structure.

33. Apparatus for accelerating a projectile comprising means forming a confined path having a longitudinal axis along which the projectile traverses, and means for supplying a pulsed plasma jet to the path and to a rear surface of the projectile as the projectile traverses the path to accelerate the projectile along the path, the supplying means including a capillary passage having a longitudinal axis and a wall formed of a confined mass of water, said passage having one closed end and an orifice at another end, the orifice leading into the confined path, means for applying a discharge voltage to the water between spaced longitudinal regions of the passage in the direction of the passage longitudinal axis so that the water forms a plasma in the passage, an electric discharge channel being formed by the plasma in the passage between the spaced passage regions while the discharge voltage is applied between the spaced regions, said one end being closed while the discharge is occurring, ohmic dissipation occurring in the electric discharge channel while the discharge voltage is applied between the spaced regions to produce a pressure in the passage to cause plasma to flow longitudinally in the passage and through the orifice to form the jet that enters the confined path.

34. The apparatus of claim 33 wherein the water is confined by an elongaed wall comprising a wall of the capillary passage and formed of a thin dielectric.

35. The apparatus of claim 33 further including a confining structure for the water, the confining structure including surfaces formed by opposite ends faces and an interior wall surface of the capillary passage, the means for applying the discharge voltage including first and second electrodes abutting against the surfaces at opposite ends of the structure.

36. Apparatus for accelerating a projectile comprising means forming a confined path having a longitudinal axis along which the projectile traverses, and means for supplying a pulsed plasma jet to the path and to a rear surface of the projectile, the means for supplying comprising a tube having a longitudinal axis and a wall, the tube having an inner diameter to length ratio to form a capillary passage, the tube having an inner wall surface defining a boundary for the capillary passasge, the wall including a dielectric ionizable substance formed of ablatable powder filler particles having a total surface area many times the surface area of the inner wall surface between displaced regions along the tube longitudinal axis and an inertial mass much greater than that of the plasma so the plasma quickly flows through and is cooled by the particles, the particles being confined by an elongated wall comprising the inner wall surface of the capillary passage and formed of a thin dielectric, and means for applying a discharge voltage to the ablatable powder filler particles between the regions to cause the substance in the particles to be ionized to form the plasma inside of the tube, the tube being dimensioned so that the plasma formed therein in response to the discharge voltage has a velocity and pressure to form the jet, the tube having a closed first end while the plasma is formed therein and a second end including an orifice into the confined path, the jet propagating along the longitudinal axis of the tube and through the orifice into the confined path generally in the same direction as the projectile is to be accelerated.

37. Apparatus for accelerating a projectile comprising means forming a confined path having a longitudinal axis along which the projectile traverses, and means for supplying a pulsed plasma jet to the path and to a rear surface of the projectile, the means for supplying comprising a tube having a longitudinal axis and a wall, the tube having an inner diameter to length ratio to form a capillary passage, the tube having an inner wall surface defining a boundary for the capillary passage, the wall including a dielectric ionizable substance formed of ablatable powder filter particles having a total surface area many times the surface area of the inner wall surface between displaced regions along the tube longitudinal axis and an inertial mass much greater than that of the plasma so the plasma quickly flows through and is cooled by the particles, a confining structure for the particles, the confining structure including surfaces formed by opposite end faces of the tube and the inner wall surface, the means for applying the discharge voltage including first and second electrodes abutting against the surfaces at opposite ends of the structure, and means for applying a discharge voltage to the ablatable powder filler particles between the regions to cause the substance in the particles to be ionized to form the plasma inside of the tube, the tube being dimensioned so that the plasma formed therein in response to the discharge voltage has a velocity and pressure to form the jet, the tube having a closed first end while the plasma is formed therein and a second end including an orifice into the confined path, the jet propagating along the longitudinal axis of the tube and through the orifice into the confined path generally in the same direction as the projectile is to be accelerated.

38. Apparatus for accelerating a projectile comprising means forming a confined path having a longitudinal axis along which the projectile traverses, and means for supplying a pulsed plasma jet to the path and to a rear surface of the projectile as the projectile traverses the path to accelerate the projectile along the path, the means for supplying the pulsed plasma jet to the path including a tube having an interior wall surface forming a capillary passage, the tube including ionizable ablatable powder dielectric filler particles abutting against the wall surface and having an inertial mass much greater than that of the plasma so the plasma quickly flows through and is cooled by the particles, means for applying a discharge voltage between spaced regions along the length of the interior wall surface while the ablatable powder dielectric filler particles are between the regions, the particles having a total surface area many times the surface area of the wall surface between the regions, the particles being confined by an elongated wall comprising the wall surface of the capillary passage and formed of a thin dielectric, the dielectric particles including at 1east one atomic element that is ionized to form a plasma in response to the discharge voltage being applied between the spaced regions, the diametric length across the passage being short relative to the distance between the spaced regions, first and second ends of the passage being respectively open and blocked while the discharge voltage is applied between the spaced regions to respectively enable and prevent the flow of plasma through them, the plasma forming an electric discharge channel between the spaced regions while the discharge voltage is applied between the regions, ohmic dissipation occurring in the electric discharge channel in response to the discharge voltage being applied between the regions to produce a pressure in the passage to cause the plasma in the passage to flow longitudinally in the passage and through the first end to form the pulsed plasma jet.

39. Apparatus for accelerating a projectile comprising means forming a confined path having a longitudinal axis along which the projectile traverses, and means for supplying a pulsed plasma jet to the path and to a rear surface of the projectile as the projectile traverses the path to accelerate the projectile along the path, the means for supplying the pulsed plasma jet to the path including a tube having an interior wall surface forming a capillary passage, the tube including ionizable ablatable powder dielectric filler particles abutting against the wall surface and having an inertial mass much greater than that of the plasma so the plasma quickly flows through and is cooled by the particles, means for applying a discharge voltage between spaced regions along the length of the interior wall surface while the ablatable powder dielectric filler particles are between the regions, the particles having a total surface area many times the surface area of the wall surface between the regions, a confining structure for the particles, the confining structure including surfaces formed by opposite end faces of the tube and the inner wall surface, the means for applying the discharge voltage including first and second electrodes abutting against the surfaces at opposite ends of the structures, the dielectric particles including at least one atomic element that is ionzied to form a plasma in response to the discharge voltage being applied between the spaced region, the diametric length across the passasge being short relative to the distance between the spaced regions, first and second ends of the passage being respectively open and blocked while the discharsge voltage is applied between the spaced regions to respectively enable and prevent the flow of plasma through them, the plasma forming an electric discharge channel between the spaced regions while the discharge voltage is applied between he regions, ohmic dissipation occurring in the electric discharge channel in response to the discharge voltage being applied between the regions to produce a pressure in the passage to cause the plasma in the passage to flow longitudinally in the passage and through the first end to form the pulsed plasma jet.

40. Apparatus for accelerating a projectile comprising means forming a confined path having a longitudinal axis along which the projectile traverses, and means for supplying a pulsed plasma jet to the path and to a rear surface of the projectile to accelerate the projectile along the path, the supplying means including a capillary passage having a longitudinal axis and a wall formed of ablatable dielectric, ionizable powder filler particles having a total surface area many times that of an exposed inner surface of the wall, the particles being confiend by an elongated wall comprising a wall of the capillary passage and formed of a thin dielectric, said passage having one closed end and an orifice at another end, the orifice leading into the confined path for applying a discharge voltage to the particles between spaced longitudinal regions of the passage in the direction of the passage longitudinal axis so that the particles form a plasma in the passage, the particles having an intertial mass much greater than that of the plasma so the plasma quickly flows through and is cooled by the particles, an electric discharge channel being formed by the plasma in the passage between the spaced passage regions while the discharge voltage is applied between the spaced regions, said one end being closed while the discharge is occurring, ohmic dissipation occurring in the electric discharge channel while the discharge voltage is applied between the spaced regions to produce a pressure in the passage to cause plasma to flow longitudinally in the passage and through the orifice to form the jet that enters the confined path.

41. Apparatus for accelerating as projectile comprising means forming a confined path having a longitudinal axis along which the projectile traverses, and means for supplying a pulsed plasma jet to the path and to a rear surface of the projectile to accelerate the projectile along the path, the supplying means including a capillary passage having a longitudinal axis and a wall formed of ablatable dielectric, ionizable powder filler particles having a total surface area many times that of an exposed inner surface of the wall, a confining structure for the particles, the confining structure including surfaces formed of opposite end faces and an interior wall surfaces, said passage having one closed end and an orifice at another end, the orifice leading into the confined path, first and second electrodes abutting against the surfaces at opposite ends of the structure for applying a discharge voltage to the particles between spaced longitudinal regions of the passage in the direction of the passage longitudinal axis so that the particles form a plasma in the passage, the particles having an inertial mass much greater than that of the plasma so the plasma quickly flows through and is cooled by the particles, an electric discharge channel being formed by the plasma in the passage between the spaced passage regions while the discharge voltage is applied between the spaced regions, said one end being closed while the discharge is occurring, ohmic dissipation occurring in the electric discharge channel while the discharge voltage is applied between the spaced regions to produce a pressure in the passage to cause plasma to flow longitudinally in the passage and through the orifice to form the jet that enters the confined path.

42. Apparatus for accelerating a projectile comprising a gun having a muzzle and a barrel with a bore adapted to receive the projectile and a breech block having a bore aligned with the barrel bore, a cartridge in the breech block bore, the cartridge including: means for supplying a plasma jet behind the projectile in the barrel bore, the plasma jet supplying means including: a first tube having an interior wall surface forming a capillary passage, the first tube comprising a confined mass of water forming a dielectric substance confined between the interior wall surface and an exterior wall surface of the tube, a power supply outside of confines of the gun, means connected to said power supply for applying a discharge voltage through electric connections extending through the breech block to first and second electrodes between spaced regions along the length of the interior wall surface while a dielectric ionizable substance is between the regions, the dielectric substance including at least one element that is ionized to form a plasma in response to the discharge voltage being applied between the spaced regions, the diametric length across the passage being short relative to the distance between the spaced regions, first and second ends of the passage being respectively open and blocked to respectively enable and prevent the flow of plasma through them, the blocked end closing the breech block bore, the plasma forming an electric discharge channel between the spaced regions, ohmic dissipation occurring in the electric discharge channel to produce a pressure in the passage to cause the plasma in the passage to flow longitudinally in the passage and through the first end to form the plasma jet having sufficient pressure to accelerate the projectile from the vicinity of the breech through the barrel and muzzle, a collar for restraining movement of the projectile into the capillary passage, the collar having secured to and extending from the first end, the collar including a bore adapted to be aligned with the bore of the gun barrel into which the cartridge is adapted to be loaded, the collar bore having the same diameter as the gun barrel bore into which the cartridge is adapted to be loaded, the collar including a shoulder against which the projectile initially bears, wherein the capillary passage includes an outwardly flared nozzle at the first end, the jet being injected through the flared nozzle agains the projectile while it bears on the shoulder and thence is injected into the barrel so the jet expands and is cooled as it enters the barrel.

43. Apparatus for accelerating a projectile comprising a gun having a muzzxle and a barrel with a bore adapted to receive the projectile and a breech block having a bore aligned with the barrel bore, a cartridge in the breech block bore, the cartridge including: means for supplying a plasma jet behind the projectile in the barrel bore, the plasma jet supplying means including: a first tube having an interior wall surface forming a capillary passage, the first tube comprising a mass of a dielectric substance confined between the interior wall surface and an exterior wall surface of the tube, a power supply outside of confines of the gun, means connected to said power supply for applying a discharge voltage through electric connections extending through the breech block to first and second electrodes between spaced regions along the length of the interior wall surface while a dielectric ionizable substance is between the regions, the dielectric substance including at least one element that is inonized to form a plasma in response to the discharge voltage being applied between the spaced regions, the diametric length across the passage being short relative to the distance between the spaced regions, first and second ends of the passage being respectively open and blocked to respectively enable and prevent the flow of plasma through them, the blocked end closing the breech block bore, the plasma forming an electric discharge channel between the spaced regions, ohmic dissipation occurring in the electric discharge channel to produce a pressure in the passage to cause the plasma in the passage to flow longitudinally in the passage and through the first end to form the plasma jet having sufficient pressure to accelerate the projectile from the vicinity of the breech through the barrel and muzzle, a second dielectric tube having an inner wall surface abutting against and confining the exterior wall surface, a metal sleeve having an inside wall surface abutting against and confining an exterior wall surface of an outside wall surface adapted to abut against and be confined by the breech bore, the means for applying including first and second electrodes located at opposite ends of the first tube, and means for establishing electric connections from the power supply to the first and second electrodes through the breech bore end, the electric connection to the second electrode being established via the metal sleeve.

* * * * *